United States Patent [19]

Andersen et al.

[11] Patent Number: 5,022,470

[45] Date of Patent: Jun. 11, 1991

[54] AUTONOMOUS RAPID THERMAL ICE PENETRATING METHOD AND SYSTEM

[75] Inventors: James K. Andersen; James W. White, both of Arnold, Md.

[73] Assignee: Ocean Systems Research, Inc., Annapolis, Md.

[21] Appl. No.: 372,664

[22] Filed: Jun. 28, 1989

[51] Int. Cl.[5] ..... E21B 7/14; E21B 7/18

[52] U.S. Cl. ..... 175/14; 175/17; 175/18; 299/14; 248/171; 248/188.3

[58] Field of Search ..... 175/18, 14, 17, 71, 175/11; 299/14, 24; 92/107; 89/1.8, 1.51, 1.814, 1.809, 1.813, 1.816, 37.09, 40.01; 60/230, 231, 228, 253, 271, 254, 255, 250, 256; 289/265.25, 265.11, 265.13; 102/202.5, 202, 202.12, 206, 425; 248/153.2, 155.3, 163.1, 188.3, 168, 169, 170, 171

[56] References Cited

U.S. PATENT DOCUMENTS

| | | | |
|---|---|---|---|
| 3,795,378 | 3/1974 | Clarke | 248/188.3 |
| 3,870,263 | 3/1975 | Hardiman et al. | 248/168 |
| 3,917,007 | 11/1975 | Tsiferov | 175/14 |
| 3,934,659 | 1/1976 | Tsiferov | 175/14 |
| 3,973,499 | 8/1976 | Anderson et al. | 102/202 |
| 4,006,876 | 2/1977 | O'Connor | 248/188.3 |
| 4,050,631 | 9/1977 | Syltebo | 239/265.25 |
| 4,651,834 | 3/1987 | Eninger et al. | 175/18 |
| 4,699,222 | 10/1987 | Taylor | 299/24 |

FOREIGN PATENT DOCUMENTS

| | | | |
|---|---|---|---|
| 977737 | 11/1975 | France | 175/18 |

OTHER PUBLICATIONS

K. W. Pearce "Some Thrust Control Methods for Solid Propellant Rockets" Journal of the Royal Aeronautical Society, vol. 65, Oct. 1961, p. 680.

*Primary Examiner*—Bruce M. Kisliuk

*Attorney, Agent, or Firm*—Charles W. Helzer

[57] ABSTRACT

An autonomous ice penetrator/payload delivery system is provided which, when once launched from its parent vehicle will, upon reaching the surface of the ice automatically right itself to proper orientation with respect to the ice surface for penetration. A modified solid propellant rocket engine is used as the heat source to penetrate the ice rapidly and automatically is ignited upon the ice pentrator/payload containment vessel attaining proper orientation with its longitudinal axis substantially normal to the ice surface. The hot gasses of combustion produced by the modified rocket engine impinge upon the ice thereby melting it. As the ice is melted and penetrated, the penetrator/payload containment vessel will follow the receding ice surface either by gravity, or by motive forces provided by the modified rocket engine, or both. In situations where the ice penetrator is launched below the surface of the ice, buoyancy built into the penetrator system containment vessel will cause it to penetrate the ice either due to its buoyancy alone or in conjunction with a motive force developed by the modified rocket engine. The penetrator system container in conjunction with the bore hole formed by the melting ice also functions as a guide to maintain verticality of the penetrator during the initial stages of penetration of the ice surface. The walls of the subsequent bore hole formed in the ice and the generally long, cylindrical shape of the penetrator/payload containment vessel body naturally coact to maintain the vertical penetration angle.

19 Claims, 6 Drawing Sheets

12
14A
14

12
14
14A 14A
14A
14
14
12

12

21
37A
35
36A
18
19
37
36
37
37A
36A 21
34C
34A
34
34B
34D
34B
34D
18
19
34C
34A
34
34B
34D
34D 14
14A 12
14
14A
14
12
14
14
14A
14

AUTONOMOUS RAPID THERMAL ICE PENETRATING METHOD AND SYSTEM

TECHNICAL FIELD

This invention relates to a novel method and system for rapidly penetrating thick polar ice for the fast follow-through delivery of various payloads such as weapons, sensors, instruments, and the like. The method and system can be used either for the rapid downward penetration or for the rapid upward penetration of the surface of thick ice.

BACKGROUND PRIOR ART

U.S. Pat. No. 4,651,834 issued Mar. 24, 1987 describes a thermal ice penetration method and apparatus for melting a hole through ice preferably utilizing thermal-chemical heating by exothermic reaction between water supplied at least in part by the melting ice and a thermal-chemical reactant, preferably lithium and/or other alkali metal or alkali metal alloy. A number of ice penetration systems and devices are disclosed in this patent all of which utilize thermal ice penetration employing the exothermal reaction technique to achieve thermal ice penetration for deploying payloads such as sensors, transducers, antennas, instruments, weapons or the like through polar ice either downwardly from above the ice surface into the water below or upwardly from the underside of the ice through the ice to the atmosphere above the ice surface.

Other approaches have been investigated to deal with the problem of penetration of thick polar ice; however, all of them including those using thermal-chemical reaction, water jet drills, kinetic energy penetrators, etc., have met with limited success. The existing thermal-chemical ice penetrators such as those disclosed in the above-noted U.S. Pat. No. 4,651,834 have proven to be too slow for most applications (taking upwards of twenty minutes to pass through ten feet of ice) and do not appear practical for the rapid delivery of large payloads through thick ice surfaces. While water jet drills are capable of rapid ice penetration, the delivery systems employing water jet drills are quite complex and costly and are not practical for creating large diameter holes. Kinetic penetrators also have been used and are capable of rapidly penetrating thick arctic ice cover, however, they are very heavy and the payload must be shock hardened to survive the penetration impact load which makes this technique tremendously expensive.

In order to overcome the disadvantages and shortcomings of the known ice penetrating methods and systems, the present invention has been devised.

SUMMARY OF INVENTION

It is therefore a primary object of the present invention to provide a new and improved method and system for rapidly penetrating thick polar ice surfaces of up to thirty feet in thickness (for example) both rapidly and efficiently with a minimum expenditure of energy resources using a modified solid propellant rocket engine as a heat source.

A further object of the invention is to provide a fully automated, ice penetrator which is both rapid and efficient and can be fully autonomous (i.e. fire and forget) for penetrating thick polar ice to accomplish the fast followthrough delivery of various payloads such as weapons, sensors, instruments and the like. The method and system can be used for either downward or upward penetration through a thick ice surface.

A novel feature of the invention is the use of a modified solid propellant rocket engine as a heat source to rapidly melt through the thick ice.

In practicing the invention, the autonomous ice penetrator/payload system, once launched from its parent vehicle will, upon reaching the surface of the ice, automatically right itself to the proper orientation with respect to the ice surface for penetration. The solid propellant rocket motor will then be ignited automatically so that the hot gases of combustion produced by the modified rocket engine impinge upon the ice thereby melting it. As the ice is melted and penetrated, the penetrator will follow the receding ice surface either by gravity, or its own motive force, or both. In situations where the ice penetrator is launched below the surface of the ice, the buoyancy built into the penetrator system container will cause it to penetrate the ice either due to its buoyancy alone or in conjunction with a motive force developed by the modified rocket engine. The penetrator system container in conjunction with the bore hole formed by the melting ice also function as a guide to maintain verticality of the penetrator during the initial stages of penetration of the ice surface. The walls of the subsequent hole formed in the ice and the generally long cylindrical shape of the penetrator/-payload containment vessel body naturally coact to maintain the vertical penetration angle. If desired, a spinning motion can be imparted to the penetrator/-payload container body by proper orientation of the exit nozzles of the modified rocket engine to thereby provide additional vertical stability to the system during operation. Upon fully penetrating the ice, the penetrator and its payload automatically will be separated by a known ejection mechanism thereby enabling the payload to carry out its assigned mission.

BRIEF DESCRIPTION OF DRAWINGS

The above and other objects, features and many of the attendant advantages of this invention will be appreciated more readily as the same becomes better understood from a reading of the following detailed description, when considered in connection with the accompanying drawings wherein like parts in each of the several figures are identified by the same reference characters, and wherein:

FIG. 6 is a longitudinal sectional view illustrating the combined ice penetrator/payload container and certain details of construction of the automatic righting mechanism shown in FIG. 5, and wherein the left hand side (as viewed by the reader) of FIG. 6 shows the supporting legs of the ice penetrator/payload container in the retracted position conditioned for delivery of the container to the surface of the ice, and the right hand portion of the figure illustrates the supporting legs in their deployed condition whereby the container will be supported on the surface of the ice in the properly oriented condition for operation of the modified, rocket engine;

BEST MODE OF PRACTICING THE INVENTION

Figure 1:
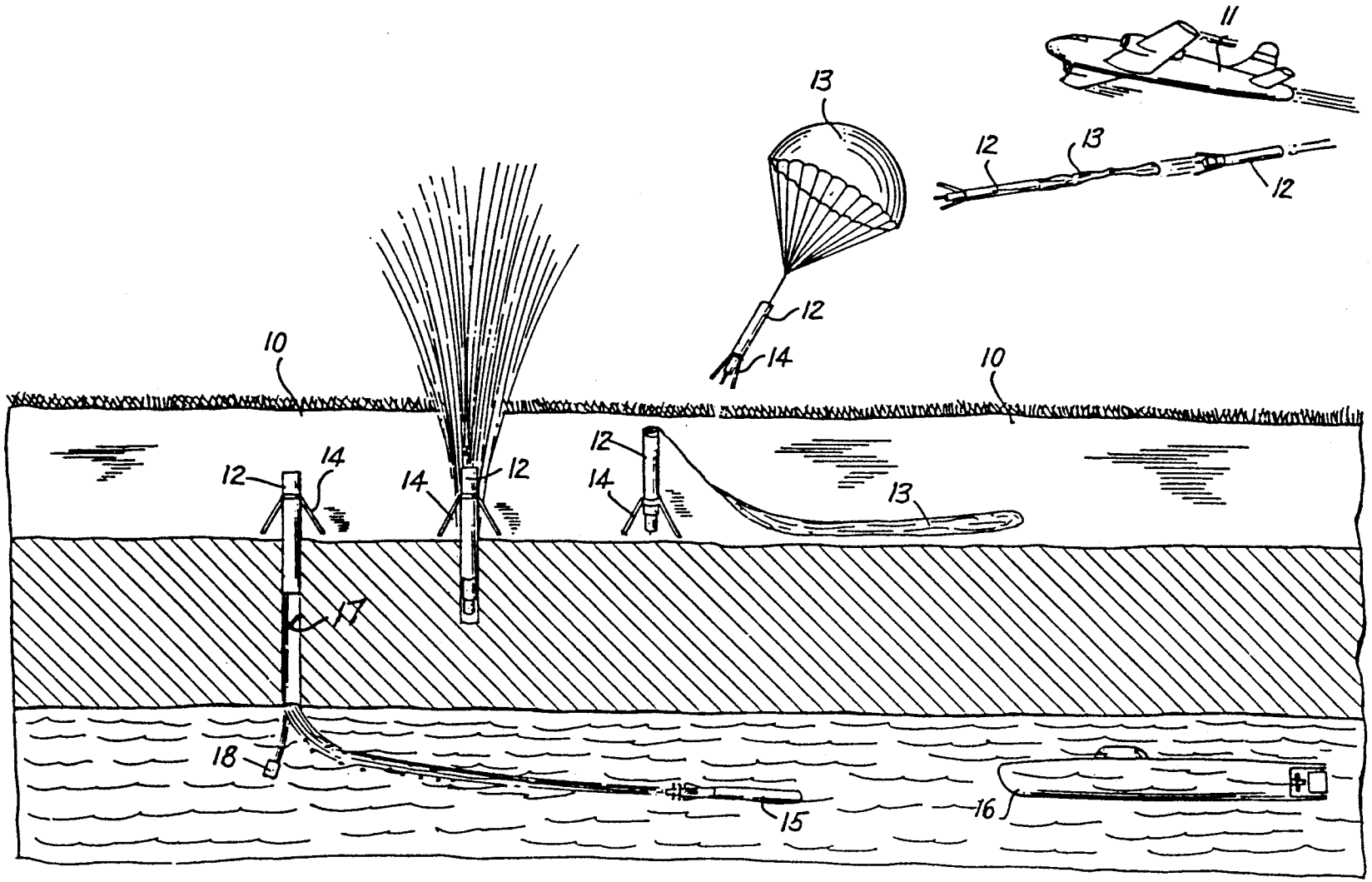
FIG. 1 of the drawings illustrates one possible scenario using a modified, solid propellant, rocket engine ice penetrator system according to the invention to deliver a large payload through an ice surface from above the surface of the ice.

FIG. 1 is an illustration of one possible scenario employing the novel ice penetrator/payload system according to the invention which can be deployed from an airplane 11. The plane 11 upon determining the presence of a hostile underseas craft such as a submarine shown at 16 can drop a combined ice penetrator/-payload container 12 on the surface of the ice at a point close to the believed location of the submarine. The container 12 preferably is in the form of an elongated cylinder having stored in its top a parachute 13 which opens and allows the ice penetrator/payload container 12 to descend to the surface of the ice 10 near a point below which the submarine 16 is submerged. In the embodiment of the invention depicted in FIG. 1, container 12 is lowered onto the surface of the ice sheet 10 by parachute 13 in a manner such that it is supported upright on support legs 14 projecting from the lower end of container 12. Supporting legs 14 maintain container 12 in an upright erect position so that its longitudinal axis is substantially normal to the surface of the ice 10. Upon thus orienting container 12, a suitable sensor in container 12, such as an accelerometer and a level (not shown), determine that the container 12 has come to rest and is properly orientated substantially normal to the surface of the ice 10. A control circuit in container 12 then causes a modified, solid propellant rocket motor (not shown in FIG. 1) to be ignited and to eject its hot combustion gasses downwardly on the surface of the ice immediately below the lower end of container 12.

Concurrently with the above-described action, suitable mechanical interlocks between the support legs 14 and the cylindrical container 12 are released so that ice penetrator and payload contained in 12 can slide downwardly and into the bore hole formed in the ice by the emission of the hot combustion gases from the rocket engine. As will be described later, the modified, solid propellant, rocket engine is designed so that the balance of forces acting on the container 12 are downward rather than upward by either the weight of the payload or by suitably deflecting the gasses to balance out or deflect any upward thrust being developed by the modified rocket engine (as will be described hereinafter more fully with relation to FIGS. 3, 8A, 8B and 8C of the drawings). Upon penetrating completely through the ice to form open bore hole passageway 17, the modified rocket engine 18 will disconnect itself by means 20 (FIG. 2) for automatically separating the payload from the rocket engine 18 and engine 18 will drop to the bottom of the ocean unless retained by some suitable restraint. As will be described more fully with relation to FIG. 2 of the drawings, the ejection of the expended rocket engine 18 allows the payload (which as shown in FIG. 1 can constitute a torpedo 15) to go into the water beneath the surface of the ice mass 10. At this point, the torpedo motor propelling and guidance system will be activated and take over to cause the torpedo 15 to hunt out and attack the submarine 16 submerged below the ice 10.

Figure 2:
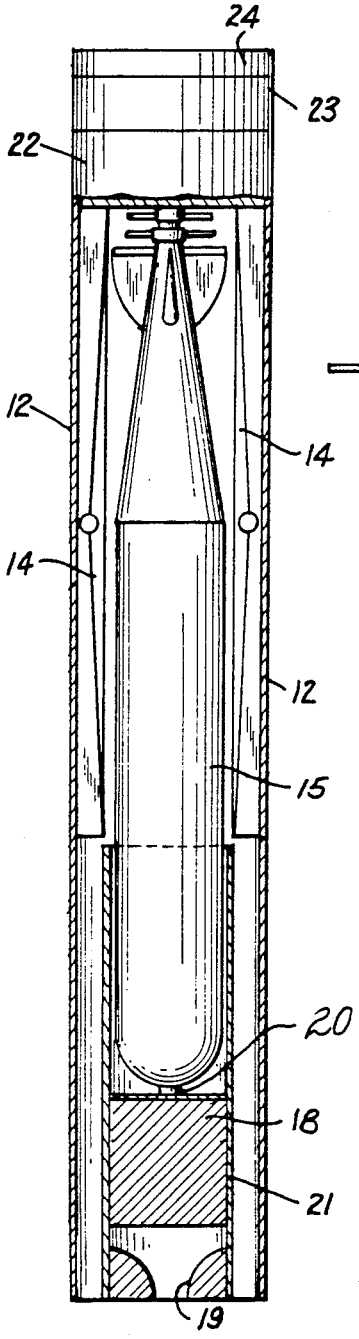
FIG. 2 is a longitudinal sectional view of a combined ice penetrator/payload constructed according to the invention and which can be used in the manner depicted in FIG. 1 of the drawings.

FIG. 2 is a longitudinal sectional view of one form of combined ice penetrator/payload within an outer containment casing 12 constructed according to the invention. In this particular embodiment of the invention, the modified solid propellant rocket motor 18 and its nozzle shown generally at 19 are supported within a separate penetrator container guide tube 21 within the outer casing 12. The outer casing 12 has longitudinally extending slots formed therein immediately adjacent the position of the support legs 14 in which the legs 14 are stored when the are in their folded-in, stored condition.

Upon the combined ice penetrator/payload container 12 coming to rest on the surface of the ice as depicted in FIG. 1, an accelerometer, timer, or other sensing instrument determines this fact and actuates a self-righting power and control system 22 mounted, for example, in the upper end of the container 12. The support legs 14 then are fully deployed in a manner which will be described hereinafter with relation to FIGS. 4, 5 and 6 or 7 of the drawings. This serves to properly orient the outer container casing 12 and enclosed ice penetrator guide tube 21 together with the modified solid propellant rocket motor 18 so that the nozzle 19 of rocket motor 18 is positioned immediately above the ice surface and in condition for ignition. Thereafter, a control and sequencing electronics stored in a chamber 23 above chamber 22 in casing 12 will ignite the modified rocket motor causing it to melt a hole through ice 10 having a diameter substantially equal to the diameter of the outer container casing 12 as described above with relation to FIG. 1 of the drawings. During operation of the modified solid propellant rocket motor, the hot combustion gas flowing through the jet openings in nozzle 19 downwardly upon the ice surface melt the ice at a very rapid rate. Simultaneously, the hot combustion gasses blow any melted water in the bore hole upwardly and out as depicted in FIG. 1 of the drawings.

It has been determined that ice having a thickness of 10 meters (30 feet) can have a bore hole cut through it by the invention in a few seconds. During penetration, by properly designing the rocket engine nozzle jet passageways, the modified rocket motor can be made to propel itself (self-propelled) so as to move at very low velocity with the propelling thrust of the rocket being just slightly in excess of the thrust produced by the hot melting gasses directed vertically down upon the surface of the ice to form the bore hole 17 shown in FIG. 1. The system is entirely selfcontained and is designed for reliable operation despite extreme temperatures ranging from −65° Fahrenheit to a 160° Fahrenheit (for example). The design is such that very little or no maintenance is required because of the simplicity of the system.

Figure 3:
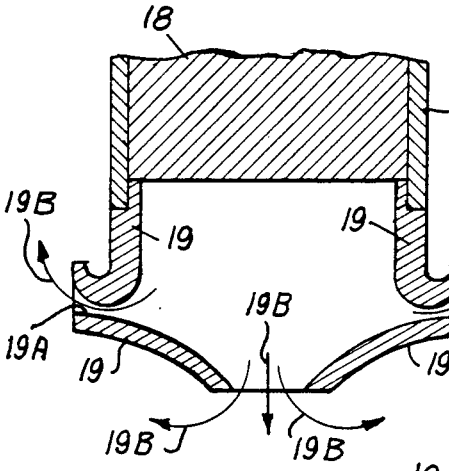
FIG. 3 is a longitudinal sectional view of one form of a low thrust nozzle construction for the modified solid propellant rocket engine used as a heat source in the rapid ice penetrator system comprising the invention.

FIG. 3 of the drawings illustrates more of the details of construction of the nozzle 19 for the modified solid propellant rocket motor whereby reduced rocket thrust is obtained. As shown in FIG. 3, the nozzle 19 may have a lower, central, aperture opening having around its upper periphery an enlarged casing portion. A number of small diameter, upwardly directed, jet nozzle openings 19A are formed circumferentially around the periphery of this enlarged casing portion of the nozzle. This results in an upwardly directed flow of a portion of the hot combustion gases produced by rocket engine 18 (indicated by the arrows 19B) which produce a net downward thrust in opposition to the generally upward thrust produced by the flow of combustion gasses 19C downwardly through lower opening of nozzle 19 onto the surface of the ice in which a bore hole is being formed.

Using an ice penetrator system similar to that shown and described with relation to FIGS. 1 and 2, if it is desired to melt a 1 foot diameter hole through a sheet of ice 10 feet thick, the quantity of solid rocket propellant can be calculated in the following manner. It is known that the latent heat of ice is equal to 144 BTU per pound and that the specific heat of ice is equal to 0.49 BTU per pound. In the above stated problem the volume of ice to be melted can be determined by the expression $\pi$ ($1.0^2/4$ feet $\times$ 10 feet = 7.85 cubic feet. The weight of ice to be melted would then be equal to 7.85 feet$^3$ $\times$ 57.2 pounds per cubic foot or = 449 pounds. The energy required to melt this quantity of ice (assuming the temperature of the ice to be at 32° Fahrenheit) is given by the expression 449 pounds $\times$ 44 BTU per pound = 64,690 BTU. It is known that the energy content of a typical solid rocket propellant is equal to 2,400 BTU per pound, and assuming an efficiency of 50%, then the total weight of the solid propellant required to form such a bore hole would amount to 54 pounds corresponding to 0.52 cubic feet of solid rocket propellant fuel.

Figures 4A, 4B, 4C, 4D, 4E, 4F, 8B, 8C:
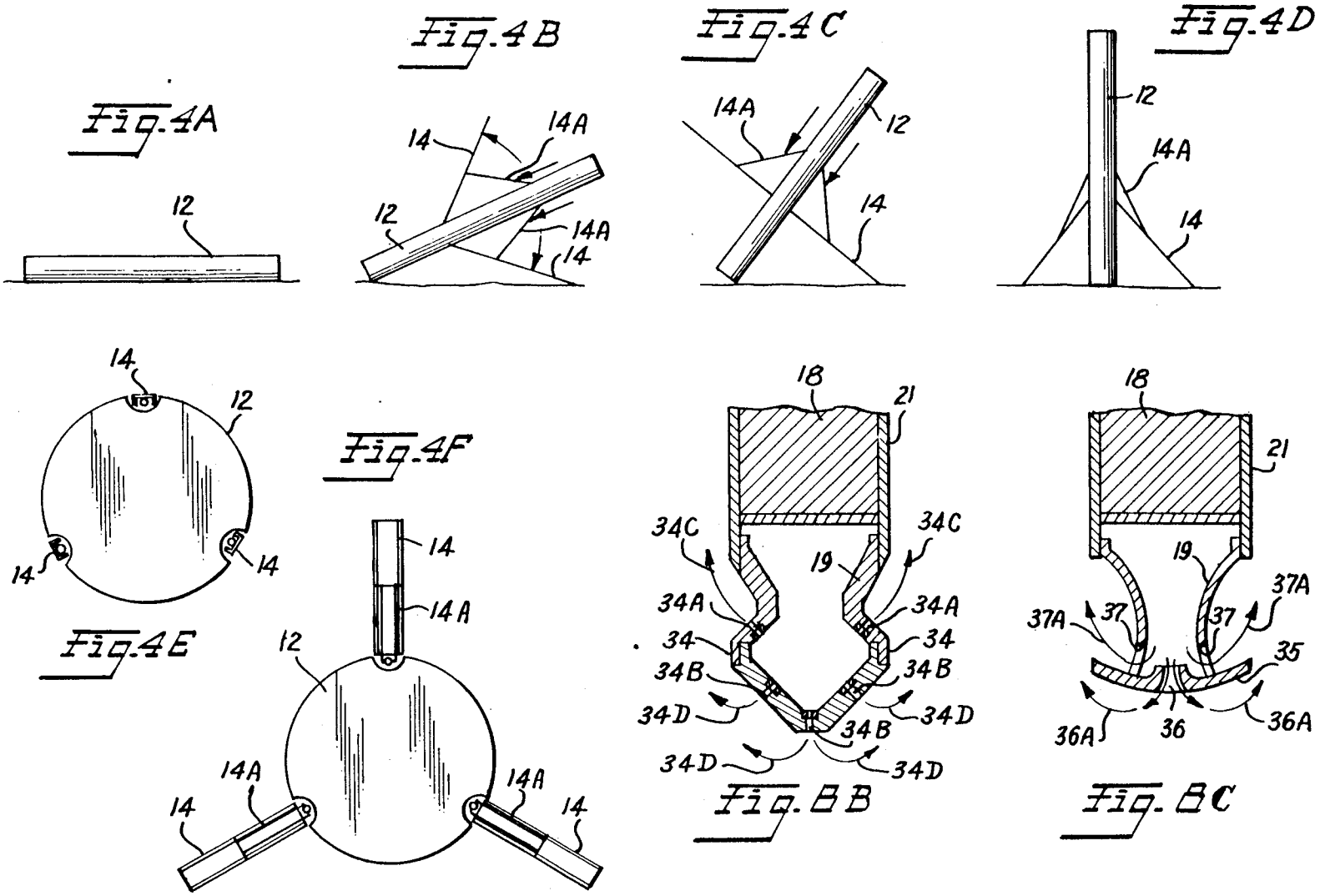
FIG. 4A through FIG. 4F illustrate one possible construction and method of operation of an automatically operating righting mechanism for properly orientating the ice penetrator relative to the surface of the ice to be penetrated to thereby place it in condition for ignition of the modified rocket engine heat source.

FIGS. 4A through 4F illustrate a different form of construction for the outer casing 12 and support legs 14 from that depicted in FIGS. 1 and 2. In FIGS. 4A through 4F, the elongated cylindrical outer casing 12 is designed so that the parachute lands the casing 12 on its side with the elongated axis of the casing 12 extending parallel to the surface of the ice. Upon this occurrence, a self-righting power and control 22 in the casing 12 senses that the casing has come to rest and initiates operation of the self-righting legs 14. This causes the self-righting mechanism to perform the sequence of actions depicted in FIG. 4B and 4C and end in placement or orientation of the outer casing 12 in an upright position as depicted in FIG. 4D. In performing this function, the support legs 14 are pivoted outwardly by pneumatic or hydraulically driven push arms 14A that slide along the longitudinal axis of the outer casing 12 and are hinged to a central part of the support legs 14 so as to cause them to move outwardly where they engage the surface of the ice. As the legs 14 are driven further by the push arms 14A, they will exert a righting moment on the cylindrical casing 12 so as to cause it to be pushed to the upright position shown in FIG. 4D. FIG. 4E is a top view of the outer casing 12 with the support legs 14 in the folded-in or stored condition and shows the triangular placement of the legs around the periphery of casing 12. FIG. 4F of the drawings is a top view of the casing 12 with the support legs 14 in the extended condition and with the outer casing 12 supported in a upright properly oriented condition having the longitudinal axis of casing 12 normal to the ice surface ready for ignition of the modified solid propellant rocket motor.

Figure 5:
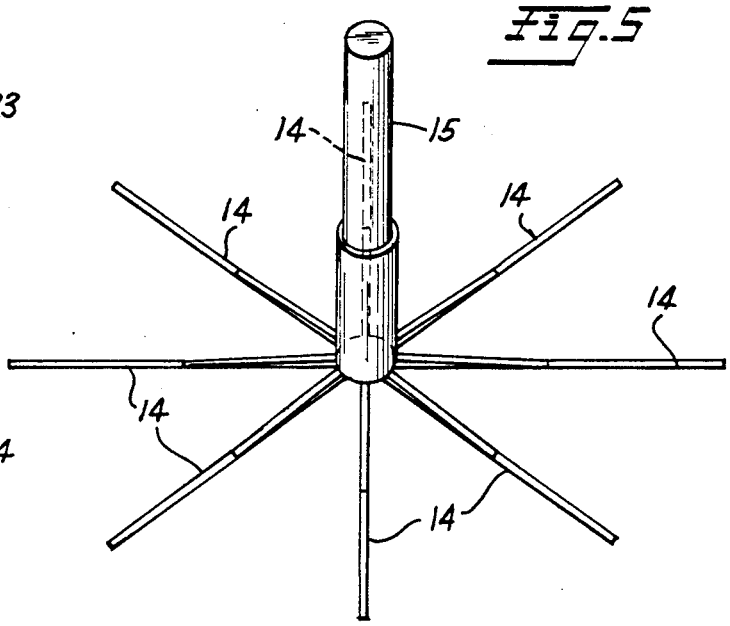
FIG. 5 is a front perspective view of an alternative form of automatic righting mechanism for use with the ice penetrator/payload system according to the invention.

From the foregoing description it will be appreciated that it is essential that the ice penetrator system be oriented approximately normal to the surface of the ice for most efficient penetration. If the penetration is to be accomplished rapidly within a time frame of a few seconds, it follows that the overall speed of the penetration system requires that the system for uprighting the ice penetrator to its desired normal condition relative to the ice surface, must also function rapidly and reliably. FIGS. 5 and 6 of the drawings illustrate a preferred form of self-righting mechanism to be designed into the ice penetrator for this purpose.

The function of the self-righting mechanism is to erect the elongated, cylindrical outer container or casing 12 in which the ice penetrator/payload are mounted from a horizontal position as shown in FIG. 4A to a substantially vertical, normal position relative to the ice surface as shown in FIG. 5, once the container has been landed on the surface of the ice. The maximum erecting torque required to accomplish this occurs when the ice penetrator/payload container 12 is near horizontal and decreases as the container approaches a vertical condition normal to the surface of the ice. The design of the self-righting mechanism therefore incorporates self-erecting drive components that matches these torque versus angle of deployment of the casing requirements. FIG. 5 of the drawings illustrates just such a self-righting mechanism with the supporting legs 14 in their extended position and supporting the outer casing 12 in an upright position normal to the surface of the ice on which it is erected.

FIG. 6 shows the details of construction of another form of self-righting mechanism shown in FIG. 5. For the purpose of illustration, FIG. 6 shows the combined ice penetrator/payload system container 12 with its right hand side as viewed by the reader having the support legs 14 extended in the deployed condition, and with its left hand portion showing the legs 14 in the folded-in, stored condition. With the elongated, cylindrical outer casing 12 and its contents landed on the surface of the ice with its longitudinal axis parallel to the ice surface as depicted in FIG. 4A of the drawings, the legs 14 will be folded-in in the stored position as shown in the left hand portion of FIG. 6. At this point the control and sequencing electronics stored in chamber 23 of the container will sense that the container is in condition for erection to the upright normal position and will activate the self-righting power and control 22 also stored in the top of container 12. The self-righting power and control 22 is comprised by a high pressure gas storage tank 25 of appropriate dimension for supplying a pneumatic fluid through a control valve 26 under the control of a control and sequencing circuit 23. This arrangement supplies high pressure gas from the storage tank 25 to a gas supply tubing 27 that is carefully threaded past the payload so as not to interfere with the payload, and connected to an outlet orifice supplying a pneumatic gas drive chamber formed within a sliding support leg extender 28 slidably mounted on the exterior of outer casing 12.

The sliding support leg extender 28 has gas sealing surfaces formed at each of its upper and lower ends 29 and 30, respectivly, such that a net downwardly acting pneumatic force drives the sliding support leg extender downwardly upon introduction of gas into the drive chamber via valve 26 and tubing 27. The lower end 31 of the sliding support leg extender 28 engages and rides upon an inwardly tapered camming surface 32 formed on the inside of its associated support leg 14. As a consequence, as the sliding support leg extender 28 is driven downward by the high pressure gas from tank 25, its lower end 31 will cam its associated support leg 14 outwardly and down to the ultimate position shown in the right hand portion of FIG. 6 thereby providing a stable support for the container 12 in an upright position normal to the surface of the ice. In attaining this position, the container 12 will go through certain of the positions depicted by FIGS. 4B and 4C of the drawings before attaining the full upright position shown in FIG. 5. In this position, the sliding support leg extender 28 will be positioned as shown in the right hand portion of FIG. 6 with the lower seal 30 located at the bottom of container 12.

Figure 7:
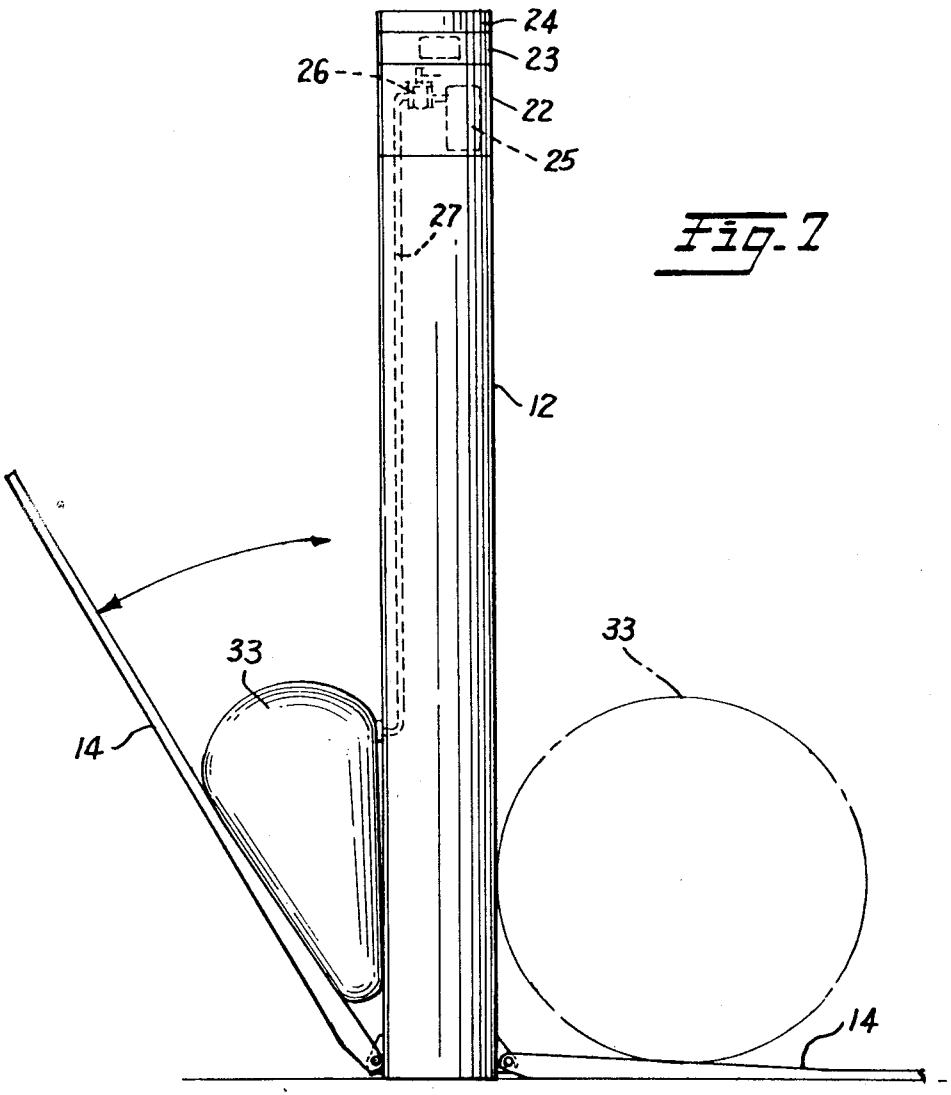
FIG. 7 is a longitudinal sectional view of a still a third automatic righting mechanism design for use with the ice penetrator/payload container and which uses, for example, an inflatable annular-shaped balloon to deploy the supporting legs for the container.
Figure 8:
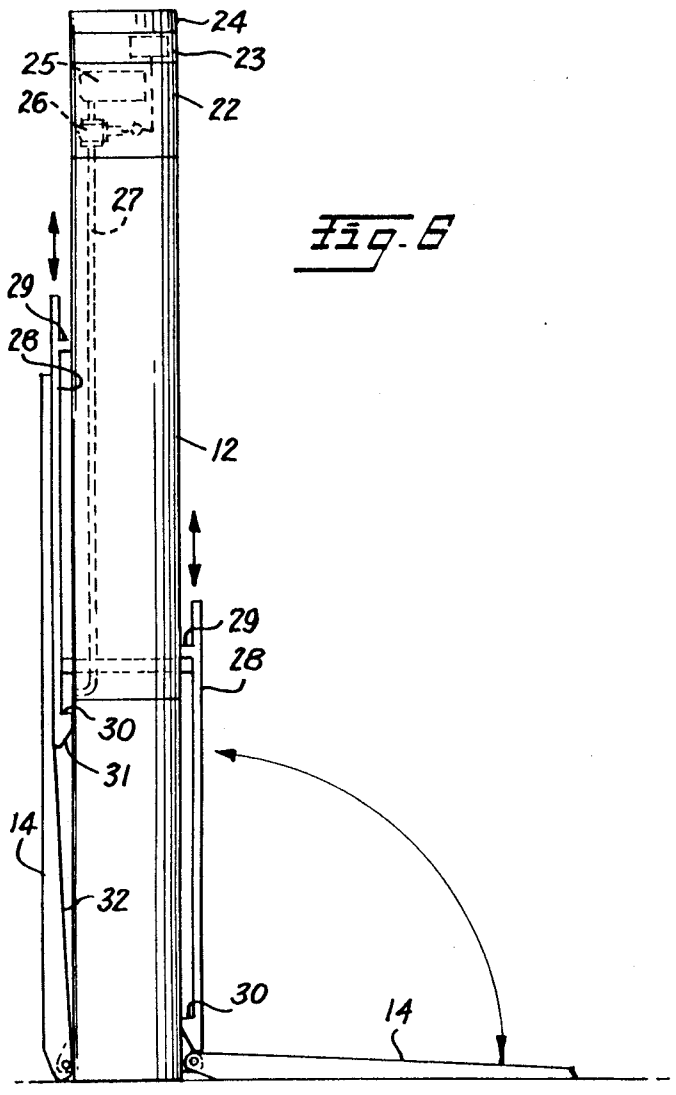

FIG. 7 illustrates still a different embodiment of a fast acting, self-righting mechanism according to the invention. In the FIG. 7 embodiment of the invention, the sliding support extender 28 and its associated seals is replaced with an inflatable annular balloon 33 that may be shaped much like the inner tube for an automobile tire. The left hand portion of FIG. 7 shows this embodiment of the invention with the inflatable balloon 33 only partially inflated and the support leg 14 only partially extended. Ultimately, the inflatable balloon 33 is fully inflated as shown in the right hand portion of FIG. 7 to cause the support legs 14 to become fully extended and maintain container 12 in an upright position normal to the surface of the ice.

Figure 8A:
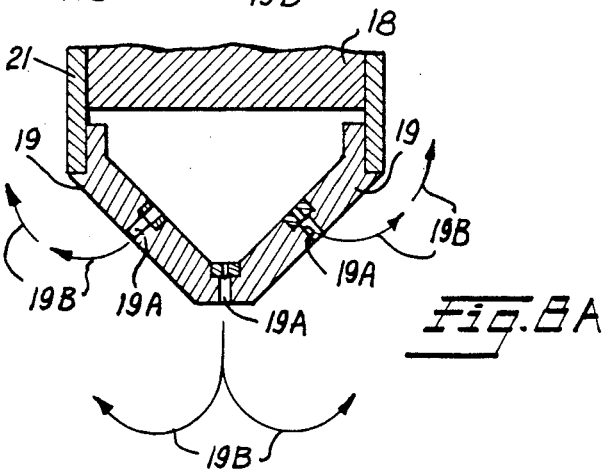
FIGS. 8A, 8B and 8C illustrate different low thrust nozzle designs that can be used with the modified rocket motor employed as a heat source whereby the rocket motors are capable of providing some motive force in the desired direction of penetration and (if desired) a slight rotation to the combined ice penetrator/payload containment vessel.

FIG. 8A of the drawings is a fragmentary, longitudinal sectional view through a modified form of the nozzle 19 that can be employed with the combined ice penetrator/payload system. FIG. 8A differs from the nozzle construction shown in FIG. 3 in that it has no provision for providing reverse thrust and is used in those applications where sufficiently reduced thrust can be obtained by appropriately sizing the nozzles 19A, relative to the combined weight of the rocket engine 18 and combined payload so that the packaged system goes through the ice in a desired direction.

The nozzle construction shown in FIG. 8B (in contrast to FIG. 8A) is designed to provide reverse thrust whereby the ice penetrator/payload is driven through the ice in a positive manner similar to FIG. 3. In FIG. 8B nozzle 19 is provided with an enlarged diameter rim portion 34. A plurality of gas outlet passageway openings 34A are formed around the periphery of the enlarged diameter rim portion 34 on its upper surfaces and a plurality of outlet openings or nozzle orifices 34B are formed around the periphery of the lower surface of the enlarged rim portion 34. With this arrangement, the gases indicated by the arrows 34C emitting from the upper array of gas jet orifices 34A will result in producing a net downward acting force that tends to drive the combined ice penetrator/payload through the bore hole in the ice while the hot gasses of combustion emitting through the orifices 34B heat and scour the melted ice water from the bore hole as indicated by arrows 34D.

FIG. 8C of the drawings illustrates still another embodiment of a nozzle construction that provides thrust reversal and that can be used with the modified, solid propellant rocket motor 18 as a heat source in the ice penetrator/payload system. In FIG. 8C, the lower, large diameter open end of nozzle 19 is provided with a diffuser plate 35 having a centrally disposed aperture opening 36 that forms the jet orifice outlet for the hot combustion gasses 36A emitted by the rocket motor. The hot gas jets 36A are directed downwardly by opening 36 onto the ice surface to form the bore hole and blow out the melted ice water as described earlier. In addition, the nozzle 19 around its periphery above the diffuser plate 35 has an annular array of upper jet openings shown at 37 which produce an upward flow of hot combustion gasses indicated by the arrows 37A so as to result in the production of a net downward acting force by the modified rocket engine thereby helping to drive it and the associated payload downward through the bore hole being formed through the ice.

In either of the nozzle designs shown in FIG. 8A, 8B or FIG. 8C any of the partially sidewise directed jet nozzles such as 19A in FIG. 8A, 34A or 34B in FIG. 8B or 37 in FIG. 8C can be provided with a slight angular twist relative to the longitudinal axis of the rocket engine whereby the container casing 12 and its contents can be provided with a slight spiral rotation during penetration for improved vertical stability.

Figure 9:
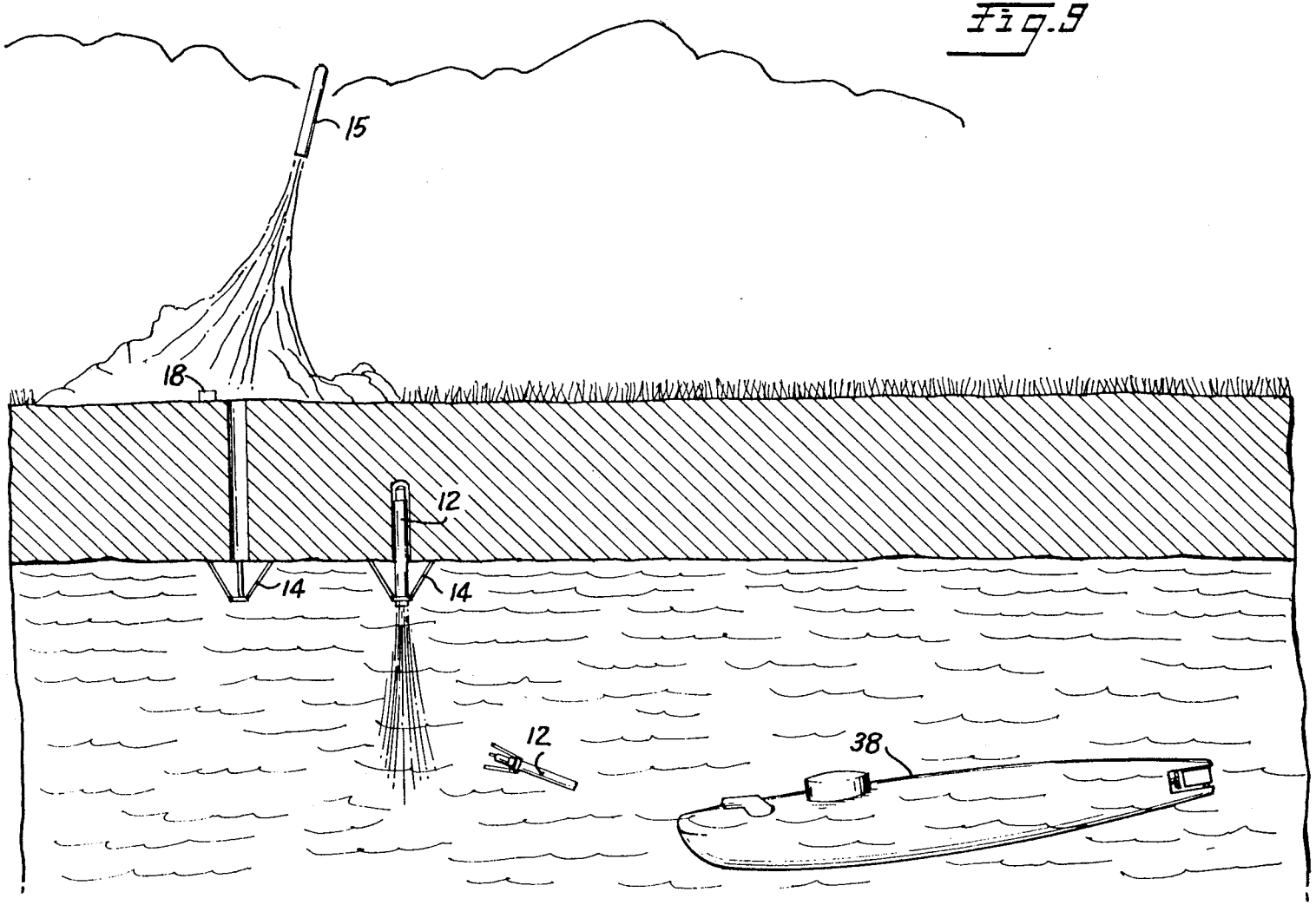
FIG. 9 illustrates a scenario wherein a combined ice penetrator/payload container constructed according to the invention is used to deliver a payload from below its surface through an ice shelf to the atmosphere above.

FIG. 9 illustrates a different scenario for use of the combined ice penetrator/payload system constructed according to the invention. In FIG. 9, the outer container 12 is designed to be deployed from a submarine such as 38 by being fired through a torpedo tube, for example. The outer container 12 used in the embodiment of the invention shown in FIG. 9 is designed such that the buoyant forces acting on container 12 and its contents while in the water cause it to float upward from its launching point and to be lodged on the undersurface of the ice at some point following its ejection into the water by the submarine, as shown in FIG. 9. At this point, the ice penetrator/payload system functions in the same manner described with relation to FIG. 1 with the exception that the entire system is now boring upwardly through the sheet of ice 10 so as to form a bore hole 17 through the ice from which the payload (in this case a ground to air missile) can escape to the atmosphere after ejecting the expended modified rocket engine 18 out of the bore hole onto the surface of the ice.

Figure 10:
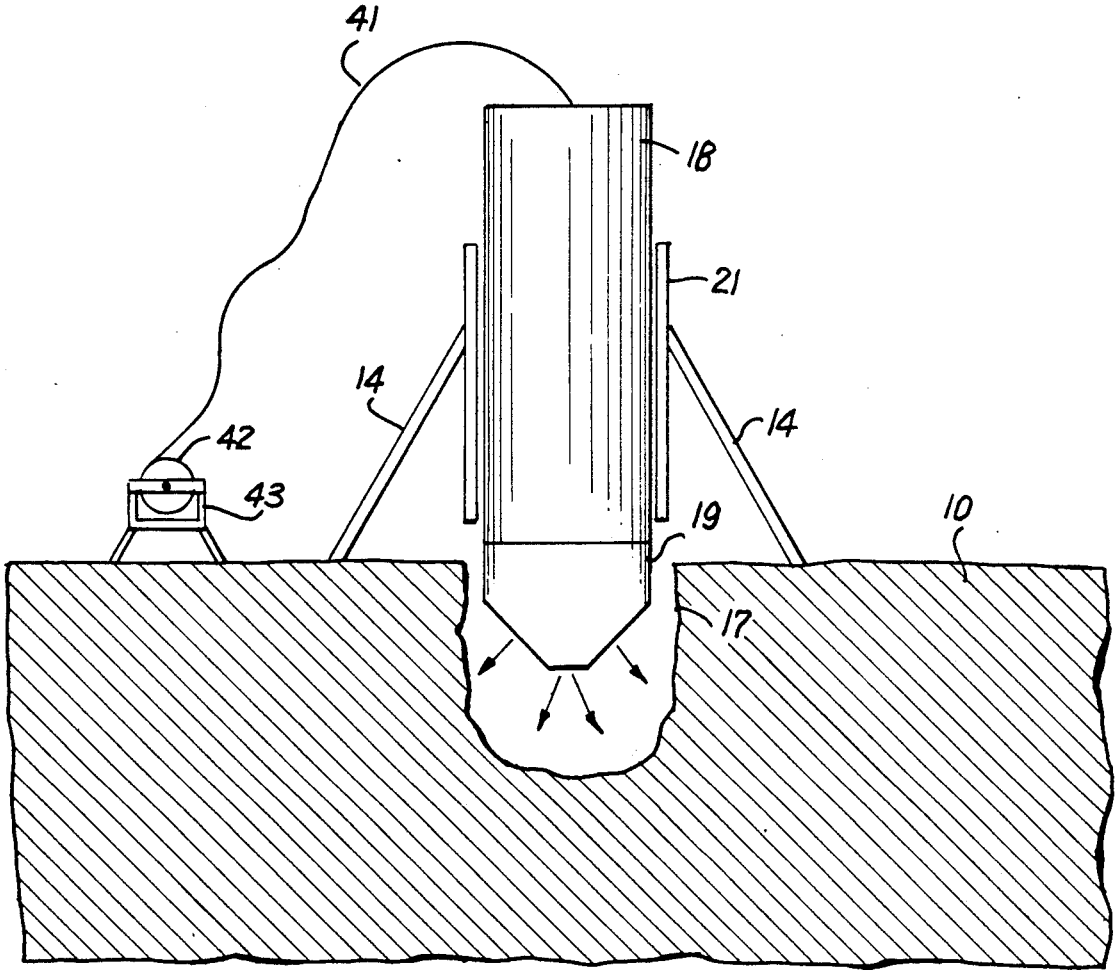
FIG. 10 illustrates a general purpose ice penetrator according to the invention used to provide a bore hole through thick ice for any desired purpose and which does not include a combined special purpose payload.

FIG. 10 of the drawings depicts a modified solid propellent rocket motor ice penetrator system according to the invention that can be used to rapidly drill bore holes through thick ice for whatever purpose, e.g., exploration, data gathering, recovery of an object located beneath the ice, access for divers, etc. In FIG. 10 the support legs 14 are designed to fold into and out from the penetrator guide tube 21 of the rocket motor 18 in place of an outer container 12 as shown in FIG. 2. Alternatively, the legs can be permanently secured to guide tube 21 as shown in FIG. 10. The element 41 is a restraint wire for retrieving the rocket motor 18 after it has penetrated the ice. Element 41 may comprise a cable dispensed from a spool 42 rotatably mounted on a stand 43 supported on the ice.

APPLICABILITY OF INVENTION

The automatically operated ice penetrator/payload system according to the invention is designed to be operated autonomously, once launched from its parent vehicle and upon reaching the surface of an ice shelf, automatically will right itself to the proper orientation with respect to the ice surface for rapid penetration. A modified solid propellant rocket motor comprising a part of the ice penetrator upon ignition produces hot gasses of combustion that impinge upon the ice thereby melting it and forming a bore hole through the ice. As the ice is penetrated, the ice penetrator will follow the receding ice surface by gravity, its own motive force, or both, in applications where the ice penetrator/payload system is positioned above the surface of the ice. In a different application, the ice penetrator/payload system can be deployed below the surface of the ice whereupon it will float up to and attach itself to the bottom surface of the ice and thereafter properly orientate itself to form a bore hole through the ice from the bottom up.

To accomplish the above-described objectives, the ice penetrator system includes a rapid acting uprighting mechanism which also functions as a guide to maintain verticality of ice penetrator during its initial stages of penetration. The walls of the bore hole being formed through the ice and the long cylindrical shape of the ice penetrator/payload outer casing naturally coact to maintain the vertical penetration angle of the bore hole. If desired, a spinning motion can be imparted to the ice penetrator system container by proper orientation of the exit nozzles of the modified solid propellant rocket motor to provide additional vertical stability to the ice penetrator system during penetration. Upon fully penetrating the ice shelf, the ice penetrator and the payload will automatically separate enabling the payload to carry out its assigned mission.

Having described several embodiments of a new and improved ice penetrator/payload system and method of operation according to the invention it is believed obvious that other modifications and variations of the invention will be suggested to those skilled in the art in the light of above teachings. It is therefore to be understood that changes may be made in the particular embodiments of the invention described which are within the full intended scope of the invention as defined by the appended claims.

What is claimed is:

1. An ice penetrator system including in combination container means for containing a modified low thrust rocket engine having a nozzle, a source of rocket fuel and rocket fuel ignition means for controllably igniting the rocket engine;

rapid automatically operating self-righting means supported on said container means for rapidly and reliably automatically orientating said container means and the rocket engine nozzle in a desired orientation relative to the ice surface with the container means resting on and above or below the ice surface prior to actuation of the self-righting means; and rocket engine ignition control means for automatically activating the rocket fuel ignition means upon the container means obtaining a desired orientation relative to the ice surface.

2. An ice penetrator system according to claim 1 further including means for supporting a payload within the container means at a location such that the payload is positioned at the end of the penetrator system away from the nozzle of the rocket engine.

3. An ice penetrator system according to claim 2 further including means for automatically separating the payload from the rocket engine and its container means upon the ice penetrator successfully penetrating through the ice mass on which the penetrator has been disposed.

4. An ice penetrator system according to claim 1 wherein the automatically operating self-righting means mounted on said container means comprises a set of support legs that automatically open outwardly from around the periphery of the container means in a manner to cause the rocket engine to be disposed with its nozzle confronting the surface of the ice mass and with the longitudinal axis of the rocket engine disposed substantially normally to the surface of the ice.

5. An ice penetrator system according to claim 4 further including sensor and control means for sensing that the container means has come to rest on the surface of the ice and for automatically operating means for moving the support legs to their outwardly extended position.

6. An ice penetrator system according to claim 5 further including means for supporting a payload with the container means in a location such that the payload is positioned at the end of the penetrator system away from the nozzle of the rocket engine and further including means for automatically separating the payload from the rocket engine and the container means upon the ice penetrator successfully penetrating through the ice on which the penetrator has been deployed.

7. An ice penetrator system according to claim 6 wherein each of the outwardly projecting support legs are hinged at the end of the container means through which the hot gasses from the nozzle of the rocket engine are directed toward the ice surface, each support leg having a slightly tapering surface extending from the hinge point to about midway its length, the space between the end of each projecting leg and the midpoint thereof being occupied by an extender slide cam mechanism driven by pneumatic or hydraulic fluid supplied from a reservoir through automatically operated control valve means whereby movement of the slide cam mechanism toward the hinged end of the leg causes each leg to be extended outwardly away from the body of the container means.

8. An ice penetrator system according to claim 6 wherein the outwardly projecting support legs for the container means are caused to be opened by an annular-shaped inflatable balloon that circumferentially surrounds the container means and upon being inflated causes the support legs to be moved outwardly to the open position.

9. An ice penetrator system according to claim 1 wherein the nozzle of the rocket engine is designed so that the engine provides very low thrust in the direction of penetration during operation of the engine.

10. An ice penetrator system according to claim 6 wherein the nozzle of the rocket engine is designed so that the engine provides very low thrust in the direction of penetration during operation of the engine.

11. An ice penetrator system according to claim 10 wherein the nozzle of the rocket engine has an enlarged diameter end portion with nozzle openings formed in opposing upper and lower surfaces of the enlarged diameter portion whereby thrust forces produced by emission of the hot combustion gasses produced by the rocket engine are substantially balanced to form a low thrust rocket engine.

12. An ice penetrator system according to claim 11 wherein the axial openings of the nozzle outlets for the hot combustion gasses of the engine are slightly canted relative to the longitudinal axis of the rocket engine whereby a slight rotational movement is imparted to the container means during operation of the rocket engine.

13. An ice penetrator system according to claim 10 wherein the nozzle of the rocket engine has a constrained diameter portion near the end thereof through which the hot gasses of combustion produced during operation of the engine are emitted, a centrally apertured baffle mounted over the open end of the constrained diameter portion of the nozzle with a small diameter central opening in the baffle, and a plurality of sideways directed nozzle openings formed around the periphery of the constrained portion of the nozzle above the baffle so as to direct hot gasses of combustion onto the upper peripheral edges of the baffle whereby thrust forces are produced acting in opposition to the thrust forces produced by the hot gasses of combustion emitted through the central aperture opening in the baffle to thereby result in a reversal of rocket thrust.

14. An ice penetrator system according to claim 13 wherein the axial openings of the nozzle outlets for the hot combustion gasses of the engine are slightly twisted relative to the longitudinal axis of the rocket engine whereby a slight rotational movement is imparted to the body of the container means during operation of the rocket engine.

15. An ice penetrator system according to claim 1 wherein the container means and its contents are designed such that the gravitational weight of the packaged system comprised by the container means and its contents overcome any buoyant forces acting on the system while submersed in water whereby the system can be used to dispense a "payload" from above the surface of an ice mass.

16. An ice penetrator system according to claim 1 wherein the buoyancy of the container means and its contents is designed such that the buoyant forces acting on the ice penetrator system while immersed in water overcome any gravitational forces acting on the system whereby the ice penetrator system can be dispensed from below the surface of the ice and used to penetrate through the ice mass to the atmosphere above the surface.

17. The method of penetrating a thick ice surface using a modified low thrust rocket engine mounted within an ice penetrator containment casing with the rocket engine having a nozzle, a source of rocket fuel and a suitable rocket fuel ignition means for controllably igniting the rocket engine, rapid and automatically operating self-righting means secured on the ice penetrator containment casing for rapidly and reliably automatically orientating the container and rocket engine nozzle in a desired orientation relative to the ice surface with the container resting on and above or below the ice surface prior to actuation of the self-righting means, and rocket engine ignition control means for automatically activating the rocket fuel ignition means upon the container means attaining a desired orientation relative to the ice surface;

said method comprising delivering the ice penetrator container to a desired location on the surface of an ice mass where it is desired to penetrate the ice mass and deliver a payload;

upon the container coming to rest on and above or below the ice surface, rapidly automatically orientating the ice penetrator container with respect to the surface of the ice mass so that it is substantially normal to the surface of the ice and the nozzle of the rocket engine is directed onto the surface of the ice mass; and automatically igniting the rocket engine upon the ice penetrator container attaining proper orientation whereby the rocket engine burns through the ice mass to form a hole therethrough for delivery of a payload to the opposite side of the ice surface.

18. A method of penetrating thick ice according to claim 17 wherein the ice penetrator container and its contents are designed such that the gravitational forces acting on the container and its contents overcome any buoyant forces acting on the combined ice penetrator system and container while the container is immersed in water.

19. A method of penetrating thick ice according to claim 17 wherein the ice penetrator container and its contents are designed with sufficient buoyancy to overcome the effect of gravitational forces acting the container and its contents while immersed in water whereby the container will float up to and press against the bottom surface of an ice mass and the ice penetrator container can be launched from a submarine or other submersible vehicle.

* * * * *